United States Patent [19]

Glusker et al.

[11] 4,139,130

[45] Feb. 13, 1979

[54] CANTEEN BELT

[76] Inventors: Peter D. Glusker, 606 Nautilus St., La Jolla, Calif. 92037; Walter C. Fontana, 1523 Via Madrina, San Diego, Calif. 92111; Mitchell L. Feingold, 602 Nautilus St., La Jolla, Calif. 92037

[21] Appl. No.: 883,410

[22] Filed: Mar. 6, 1978

[51] Int. Cl.[2] ..... A45C 1/04

[52] U.S. Cl. ..... 224/5 W; 222/175; 2/312

[58] Field of Search ..... 224/5 W, 5 R, 9, 8 R, 224/11, 5 H, 26 R, 26 C, 26 H; 222/175, 529, 530; 2/312; 150/1; 9/340

[56] References Cited

U.S. PATENT DOCUMENTS

| | | | |
|---|---|---|---|
| 2,656,958 | 10/1953 | Austin | 224/5 W |
| 2,684,787 | 7/1954 | Charpiat | 224/5 W |
| 4,030,646 | 6/1977 | Switack et al. | 224/26 R |

*Primary Examiner*—Trygve M. Blix
*Assistant Examiner*—Kenneth W. Noland
*Attorney, Agent, or Firm*—Brown & Martin

[57] ABSTRACT

An easily worn and adjustable canteen belt for use by a runner or other athlete (hiker, climber, cyclist, etc.) in readily obtaining a drink of water or liquid to the full capacity of the canteen belt, without assistance and on demand, and not requiring a change of pace or stride of the wearer.

4 Claims, 8 Drawing Figures

CANTEEN BELT

BACKGROUND OF THE INVENTION

To sustain their arduous activity, distance runners require water or liquid for thirst or refreshment along their route. Additionally, recent medical evidence and studies indicate that loss of body fluid and electrolyte can be life threatening to an athlete due to such causes as dehydration, heat exhaustion, and electrolyte imbalance. Present ways of providing liquids to runners are often so cumbersome that they are not employed. In meeting this need, methods should be devised that do not encumber or weight the runner any more than absolutely necessary, and at the same time provide an adequate supply of water. Any break in the pace or stride is highly undesirable and is to be avoided. Further, individual runners vary in their need for water both as to the quantity and timing of its availability. The requirements are applicable to athletes in competition and also to those who engage in the sport of running for recreation and well-being.

In meeting these conflicting demands, several solutions may be employed. Runners may carry water containers in their clothing or strapped to their bodies. Most available containers with an appropriate supply of water are cumbersome, and tend to impede the movements of the runner by their presence and location on the body. In addition, transfer of the water or liquid from the container to the mouth of the runner is awkward and inefficient, and the arm and head movements required to obtain a drink tend to interfere with the stride of the runner. Such difficulties are compounded in the re-use of many containers, either because of the inability to reseal the container, or the failure to make use of its capacity without further interfering with the motion of the runner. A usual method to supply water is to furnish stations along the course of the run at which a container is picked up by the runner, water is used or consumed from it, and then the liquid container is discarded. The latter procedure minimizes the weight carried and the interference with the freedom of movement, but has several inherent disadvantages. Primary among these is the need to have a pre-planned course and utilize the assistance of others in establishing and maintaining the stations. Without cooperative and understanding assistance, it is nearly impossible for the runner to maintain his stride in obtaining refreshment. Unless there are numerous stations, such prelocation further requires the runner to discipline his requirements for moisture to station location rather than his own needs determined by his existing condition on the course. The latter factor adds a significant additional demand in run planning and enjoyment.

It is desirable, therefore, to have a canteen belt for a runner that carries sufficient water or liquid in a comfortable and convenient manner without interference with body movement, and from which the capacity of the container can be easily and efficiently withdrawn by the runner unassisted and when desired. With such a belt, the runner's refreshment is made independent of pre-arranged support stations except perhaps for the furnishing of a full replacement canteen belt under particular course circumstances.

SUMMARY OF THE INVENTION

The canteen belt revealed in this invention consists of a supple support belt worn about the waist of the runner. Provision is made for adjustably securing the belt by cooperating hook and pile sections at either end. In addition the support belt has an elastic section to permit its expansion and contraction so as to maintain a comfortable tension on the belt during use.

Carried within an envelope-like pocket formed by a fold in the support belt is an elongated flexible water pouch that is held to a flat cross section by having the opposite sides of the pouch join together at points along the pouch length. A fill and suction assembly connection is made in one side of the water pouch which protrudes through and is fastened to the support belt at an opening therein.

A tube leads from the fill and suction assembly connected of the water pouch and is of such length as to reach the mouth of the runner. One end of the tube is connected to a check valve outlet located at the fill and suction connection of the water pouch, the other end of the suction tube is equipped with a soft plastic mouthpiece which can be held between the teeth or lips. The check valve permits withdrawal of water from the pouch, but prevents return flow. Provision is made on the support belt to attach the mouthpiece in order to support it and the suction tube at a convenient location when they are not in use.

To withdraw water from the water belt, the runner places the mouthpiece in his mouth and draws upon it creating a suction within the tube. This action draws water from the pouch and delivers it to the mouth of the runner. The check valve prevents reverse flow and thus prevents air swallowing and provides an even more readily available liquid supply to the runner for subsequent drinks. The check valve is the key to being able to suck liquid easily from the tube without requiring either massive suction effort, intermitten filling of the suction tube, or risk of excessive air swallowing. The expandable fit to the body of the wearer and agitation of the canteen belt contents due to his activity further assists in delivery of liquid by improving distribution and creating a slight pumping action controlled by the check valve. The novel configuration of the water pouch and its fittings, combine with the motion of the runner and the pressure maintained on the pouch by the support belt, to allow easy withdrawl of the full contents of the pouch.

A primary object of this invention is to provide a new and improved canteen belt for use by a runner. An additional object is to provide a canteen belt that may be comfortably worn and avoiding encumbrance and interference with the activity of the wearer. The canteen belt of this invention provides a supply of water or liquid to the runner on his demand and without outside assistance or alteration to his pace or stride. An additional object of this invention is to provide a canteen belt permitting the full water capacity of the belt to be withdrawn readily by the runner without altering its position or location. A further object of this invention is to provide a canteen belt that is quickly and easily donned and adjusted for easy replacement of the canteen belt while running. Further objects and advantages of the canteen belt construction and operation will become apparent in the following detailed description of the accompanying drawings, wherein like numerals refer to like parts throughout and in which:

DETAILED DESCRIPTION OF THE DRAWINGS

Figure 1:
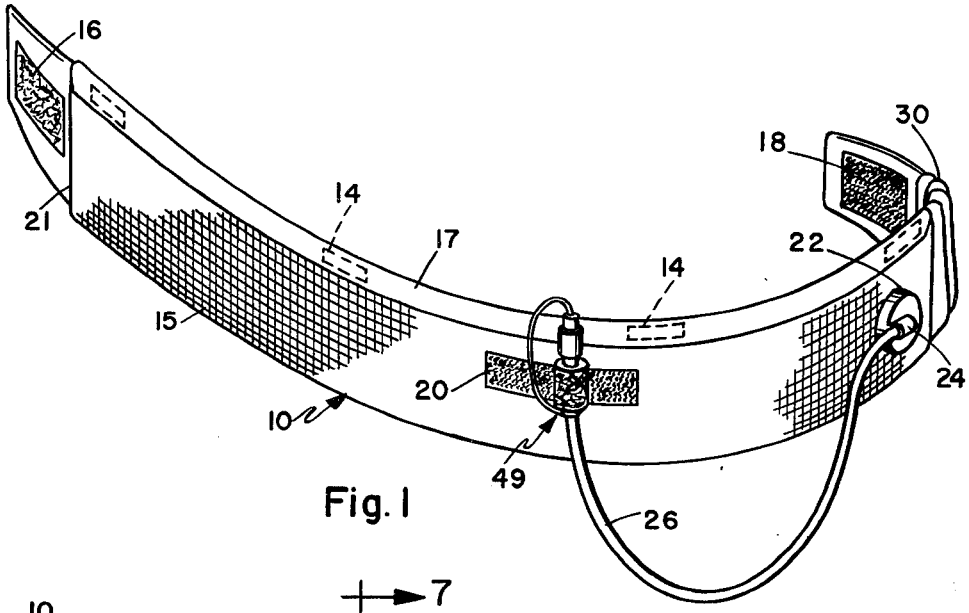
FIG. 1 is a perspective view of the canteen belt.
Figure 2:
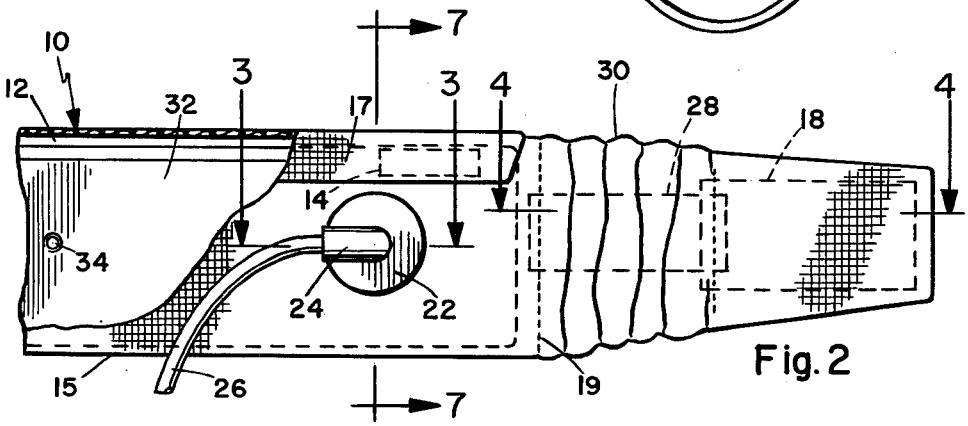
FIG. 2 is an enlarged side elevation view of one end of the canteen belt with a portion cut away.

The exterior of the canteen belt is shown in FIG. 1 and 2. The support belt 10 is made from terry cloth in this embodiment, but could be of any flexible and supple material such as cloth or plastic. An envelope-shaped pocket 12 is formed by the two sides of the support belt 11 and 13, FIG. 3, being folded together along the bottom edge 15 and stitched at the end 19 and 21. The top of the pocket is closed by flap 17 formed by an extended width of one side of support belt 10 and is secured by hook and pile attachments 14 positioned along the length of the flap 17 between it and the facing belt side.

Figure 4:
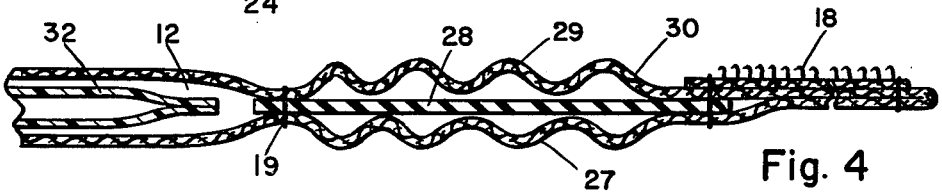
FIG. 4 is an enlarged sectional view taken on line 4–4 of FIG. 2.

The support belt is secured and adjusted about the waist of the runner by the hook 16 and the pile 18 fasteners at the ends of the belt. Support belt 10 is provided with an expandable section 30 in one end to permit maintenance of tension on the fastened belt. Detail of this section is shown in FIG. 4 wherein a length of elastic material 28 is shown stitched into the support belt, forming a portion thereof. The elastic portion 28 is covered by the material of the support belt sides 27 and 28 which are longer than the elastic material 28, forming a stretchable bellows portion in the belt.

A circular opening 58 in the exterior side of the support belt permits access to the water storage pouch 32 contained within the belt pocket 12. Pile mounting pad 20 is located on the outside of support belt 10 for attachment of the mouthpiece assembly 49 when the latter is not in use.

Figure 5:
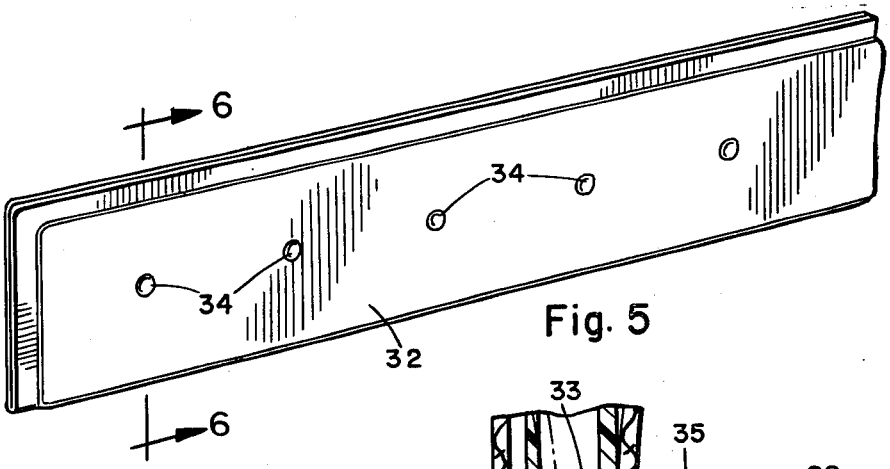
FIG. 5 is a perspective view of a portion of the water pouch.
Figure 6:
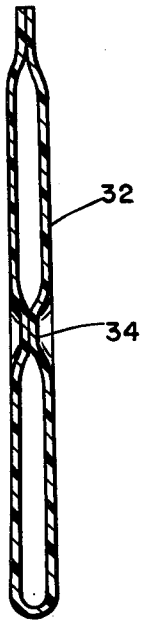
FIG. 6 is an enlarged sectional view taken on line 6—6 of FIG. 5.

The water storage pouch 32 is shown in FIGS. 5 and 6. It is an elongated water-tight container of thin cross-section formed from clear plastic. To maintain the thin cross-section, the sides of the pouch 32 are joined together at a series of points 34 along the center line length of the pouch by spot welding of the plastic material. This configuration enables the filled water storage pouch to be filled into the support belt pocket 12 and also maintains an even distribution of the water content of the pouch.

Figure 7:
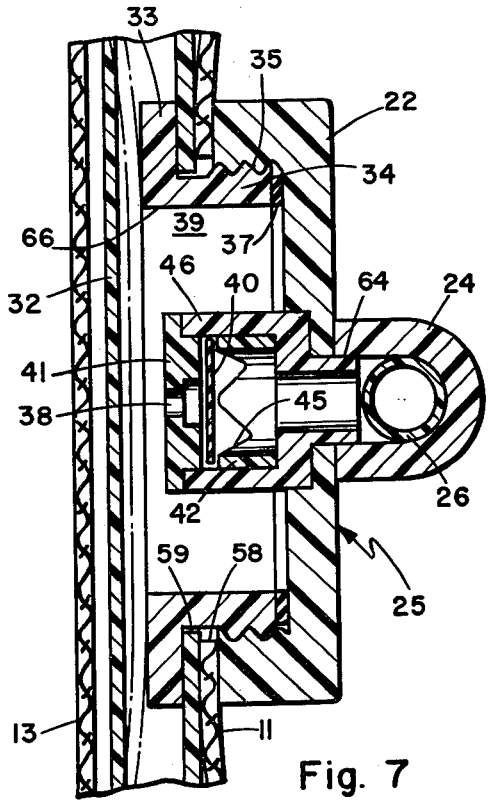
FIG. 7 is an enlarged sectional view taken on line 7—7 of FIG. 2.

Referring now to FIG. 7, a circular fill and suction aperture 69 is located in one side of the water storage pouch 32 coinciding with the water pouch access opening 58 in the support belt. A cylindrical water reservoir 34 with an end flange is attached to the water storage pouch at its flange surface 33 by a water proof cement connection. The cylindrical body of reservoir 34 passes through the circular opening 58 in the side of the support belt 10 when the water pouch is placed in pocket 12. External threads 35 on the reservoir mate with the interior threads of filling cap 22. Filling cap 22 and gasket 37 seal the reservoir. The annular space 39 within the storage reservoir 34 serves as a water sump to facilitate suction on the water content of the storage pouch.

Figure 3:
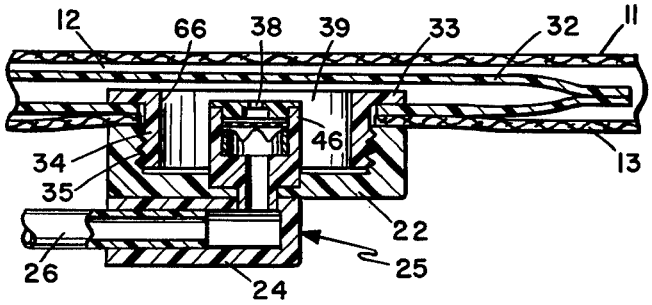
FIG. 3 is an enlarged sectional view taken on line 3—3 of FIG. 2.

Water is added to, or withdrawn from, the water storage pouch 32 through a fill and suction assembly 25, shown in detail in FIGS. 3 and 7. The assembly consists of filling cap 22 containing a central access aperture 64, and a check valve mounted on filling cap 22 and extending through the central aperture 64 into the interior 39 of reservoir 34. A right angled check valve body is formed by a cylindrical outlet chamber 24, mounted flap atop filling cap 22 covering aperture 64. A connecting cylindrical inlet chamber 46 is attached to the underside of filling cap 22 with one end extending through aperture 64 and connecting into chamber 24 to form a continuous interior water passage between the inlet and outlet chambers. The second end of the inlet chamber 46 is closed by plug 41 which has an inlet hole 38 in its center. The flow of water through hole 38 and the valve body is controlled by a check valve formed by valve disc 40 and a disc retainer 42. Disc 40 is positioned loosely in the chambered interior of the inlet chamber 46 and covers the interior end of inlet hole 38. The motion of disc 40 is constrained to the opening and closing of inlet 38 by retainer 42 which is press fitted within the interior of the inlet chamber 46. The disc retainer 42 is a hollow cylinder provided with openings 45 cut in its walls at one end to permit the flow of water through to its interior.

With fill cap 22 installed and tightened, the recessed position of plug 41 with relation to the reservoir opening 66 serves to prevent the sealing of the check valve hole 36 by the opposite side of the storage pouch 32 when a suction is taken on the water storage pouch.

Figure 8:
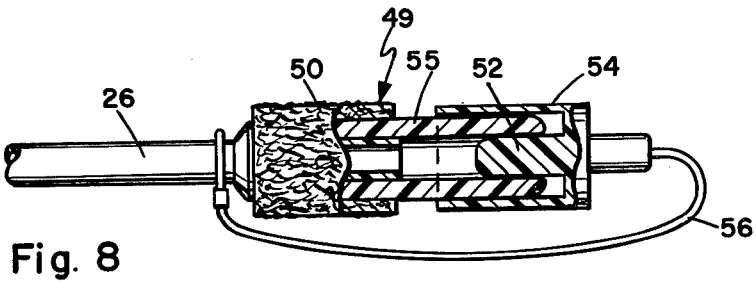
FIG. 8 is a side elevation view of the mouthpiece assembly, with portions cut away.

One end of suction tube 26 is connected in the outlet chamber 24 of the check valve body and is of a length to reach the mouth of the runner. The opposite end of suction tube 26 is attached to the mouthpiece assembly shown at 49 in FIG. 8. Mouthpiece 55 is secured over the end of the suction tube 26. The mouthpiece is provided with a removable cap 54 covering a portion of its external surface and having an internal stopper 52 which seals the mouthpiece to prevent leakage from the suction tube. Lanyard 56 connects cap 54 to the suction tube 26 to prevent the loss of the cap during mouthpiece useage. A portion of the mouthpiece outer surface is jacketed by pile material 50 permitting the easy attachment of the mouthpiece assembly 49 and the free end of the suction tube 26 to the support belt at mounting pad 20, FIG. 1.

Referring to FIGS. 1 and 7, the canteen belt functions in the following manner. It is filled by removing cap 22 and introducing water or liquid into the storage pouch via reservoir 39. The pouch vents through the same opening. The location of fill and suction assembly 25 near an end of the belt facilitates such filling and venting. To obtain a drink of water from a filled and sealed canteen belt, the runner takes the mouthpiece assembly 29 from its storage pad 20 at his waist. After removing cap 54, he places the mouthpiece in his mouth and draws a suction through it. The suction created in tube 26 causes the check valve disc 40 to be displaced from opening 38 allowing the suction within the check valve outlet side to draw water from the water storage pouch reservoir sump 39. The water is then drawn past the check valve disc and through openings 45 in the disc retainer 42 to the interior of suction tube 26, and thence to the mouth of the runner. When the runner ceases to draw upon the mouthpiece 55, no further water is withdrawn from the storage pouch and valve disc 40 seals the inlet opening 38, trapping water in the suction tube 26 until the runner again draws upon the mouthpiece. The expandable fit of the canteen belt and the motion of the runner serve to both distribute the liquid within water storage pouch 32 and develop a pumping action to assist in delivery of liquid to suction tube 26 via the check valve formed by valve disc 40 and valve disc retainer 42. After replacing cap 54, the runner attaches the mouthpiece by means of the pile surface 50 to the hook mounting pad 20 on the support belt.

Having described our invention, we claim:

1. A canteen belt permitting a runner to obtain a drink of water or liquid unassisted and on demand without change of pace or stride comprising:

a supple support belt with an exterior mounting pad and containing an envelope-shaped pocket formed by sides of said support belt and provided with an access opening, means for fastening and adjusting said support for an expandable fit about the waist of the runner, a flat flexible and elongated water storage pouch provided with a fill and suction connection opening in one side and supported within said support belt pocket and compressible against the wearer by the expandable fit of said support belt, the interior opposite sides of said water storage pouch being joined together at a plurality of points along its centerline length to maintain a thin cross section for even water distribution within said water pouch, a cylindrical water reservoir attached to said water pouch at said fill and suction opening and extending through the access opening in said support belt pocket when said water storage pouch is fitted therein, a fill cap sealing said water reservoir and containing a central aperture, a check valve mounted in said central aperture of said fill cap permitting uni-directional flow from said water pouch through inlet and outlet chambers of said check valve, a flexible suction tube one end of which is connected to said check valve outlet chamber and of appropriate length to reach the mouth of the runner, a cylindrical mouthpiece connected to the second end of said suction tube allowing the runner to suck water from the tube with his mouth, means for attaching said mouthpiece and suction tube to said support belt mounting pad for their ready availability.

2. A canteen belts as recited in claim 1, wherein said water pouch reservoir protrudes through the connection opening of said support belt.

3. A canteen belt as recited in claim 1, wherein the fastening and adjusting means comprises:

a pile section at one end and a cooperating hook section at the opposite end of said support belt for adjustably securing the belt about the wearer, an elastic section of said support belt allowing an expandable fit of said support belt.

4. A canteen belt as recited in claim 1, wherein said check valve further comprises:

a right angled cylindrical valve body attached to said reservoir cap and having the water outlet chamber mounted flush with the exterior of said cap to avoid interference with the wearer and the inlet chamber projecting through the central aperture of said reservoir cap and into the interior of said water pouch reservoir, a central hole in said valve body water inlet chamber forming a recessed intake with respect to said reservoir inlet to prevent its closure when a suction is drawn on said water pouch, a water check valve disc sealing the interior end of said central opening, a water check valve disc retainer fitted in the interior of said check valve inlet chamber constraining the movement of said water check valve disc, said retainer containing apertures to permit the flow of water to the interior thereof.

* * * * *